US008470732B2

(12) United States Patent
Stork et al.

(10) Patent No.: US 8,470,732 B2
(45) Date of Patent: Jun. 25, 2013

(54) THERMOSENSITIVE RECORDING MATERIAL COMPRISING A BACK COATING

(75) Inventors: Gerhard Stork, Flensburg (DE); Lerius Karsten, Munkbrarup (DE)

(73) Assignee: Mitsubishi HiTec Paper Europe GmbH, Flensburg (DE)

( * ) Notice: Subject to any disclaimer, the term of this patent is extended or adjusted under 35 U.S.C. 154(b) by 456 days.

(21) Appl. No.: 12/677,119

(22) PCT Filed: Sep. 2, 2008

(86) PCT No.: PCT/EP2008/007151
§ 371 (c)(1), (2), (4) Date: Mar. 9, 2010

(87) PCT Pub. No.: WO2009/033590
PCT Pub. Date: Mar. 19, 2009

(65) Prior Publication Data

US 2010/0197493 A1 Aug. 5, 2010

(30) Foreign Application Priority Data

Sep. 10, 2007 (EP) ..... 07017657

(51) Int. Cl.
*B41M 5/30* (2006.01)

(52) U.S. Cl.
USPC ..... 503/200; 503/226

(58) Field of Classification Search
None
See application file for complete search history.

(56) References Cited

U.S. PATENT DOCUMENTS 4,590,499 A * 5/1986 Fujimura et al. ..... 503/209

* cited by examiner

*Primary Examiner* — Bruce H Hess
(74) *Attorney, Agent, or Firm* — Cozen O'Connor

(57) ABSTRACT

A thermosensitive recording material comprising a substrate, a thermosensitive recording layer applied to the front and a back coating which comprises a polyurethane-based-cross-linking component in addition to pigments and binders.

10 Claims, No Drawings

THERMOSENSITIVE RECORDING MATERIAL COMPRISING A BACK COATING

PRIORITY CLAIM

This is a U.S. national stage of application No. PCT/EP2008/007151, filed on Sep. 2, 2008. Priority is claimed on the following application: Country: EP, Application No.: 07017657.3, Filed: Sep. 10, 2007, the content of which is/are incorporated here by reference.

FIELD OF THE INVENTION

The invention concerns a heat-sensitive recording material with a substrate that has at least one heat-sensitive recording layer on one side and a backing layer on the other side. The heat-sensitive recording layer has at least one dye precursor and at least one dye acceptor, which react with one another under the action of heat to form color.

BACKGROUND OF THE INVENTION

DE 38 36 660 C discloses a heat-sensitive recording material of the type described above. The back coating can be formed from water-soluble high polymers, such as starch, gelatin, styrene-maleic anhydride copolymer hydrolyzates, or polyvinyl alcohol, and from water-insoluble polymers, such as latices. In this connection, the polymers are used alone or as a mixture. When the previously known recording material is used as a label, the previously known back coating is intended to prevent any plasticizers in particular which may be present on the sheet that is to be provided with the label from penetrating into the recording layer from the back and thus causing the printing which may be present from fading or disappearing.

DE 37 20 171 A (CA 1,283,780 C) hopes to realize a comparable protective effect for the barrier layer applied to the back of a proposed heat-sensitive recording material that has a colored fluorescent dye composition in its recording layer. The barrier layer comprises essentially water-soluble polymer materials, such as polyvinyl alcohol, various cellulose ethers, starch, gelatin, casein, and polyvinyl pyrrolidone, and water-dispersed resins such as polystyrene emulsions. The function of the barrier layer is protection from materials such as oils and plasticizers known to be able to cause discoloration and/or decoloration of the images developed in the recording layer.

The objective of WO 99/14056 A1 (U.S. Pat. No. 6,326,330 B1) is to allow back-side printing of a heat-sensitive recording material by offset printing or flexographic printing after the application of a back coating that has a good barrier effect against the substances used in offset and flexographic printing, especially organic solvents, as well as against plasticizers, oils, and fats. To achieve this objective, the back coating of the previously known recording material has a mixture containing starch, an acrylate copolymer which is free of styrene or vinyl acetate components and has a film-forming temperature below 5° C., preferably below 2° C.; and an alkaline catalyst such as calcium carbonate.

Thus, it is precisely this last-cited document which reveals that the back of heat-sensitive recording materials can be used as a substrate for offset printing. The prior-art recording materials have absolutely proven themselves effective with respect to their barrier effect against the chemicals used with them. If, on the other hand, high-grade, pigment-containing back coatings are desired for, for example, full-surface reproduction of multicolor prints, in the past it was necessary in some cases to deal with considerable difficulties in the actual printing process with its demands on the surface to be printed, because deposits on the blanket make trouble-free and thus effective printing more difficult. Therefore, the object of the present invention is to make available to the public a heat-sensitive recording material with a back coating which offers a barrier effect against substances used in offset and flexographic printing, especially organic solvents, plasticizers, oils, and fats, and which at the same time can be printed well without any problems by the offset and flexographic printing processes.

SUMMARY OF THE INVENTION

The heat-sensitive recording material proposed here, which has a heat-sensitive recording layer on the front, is preferably intended for possible use

- as a ticket the appearance of which is subject to high demands after printing on both sides, and/or
- as a passenger ticket, the design of which increasingly requires at least excellent offset and flexographic printability on the back and very good ability to be stamped and canceled on the front. Good ability to be stamped and canceled is considered to be present if stamped cancellation marks cannot be completely wiped off after about 10 seconds, either in a dry or moistened condition.

If, as specified here in the statement of the object, a preferred heat-sensitive recording material to be considered is one which not only can be printed on the back but also can be stamped and canceled on the front, it must be kept in mind that the front and back coatings of the substrate between the two coatings can mutually affect each other. To solve a problem framed in this way, the focus of the invention must be directed not only on the back of the new recording material but also on its front, i.e., its heat-sensitive recording layer and/or the protective layer covering the heat-sensitive recording layer. Although, for economic reasons, the new recording material ideally should not have to be covered by an additional protective layer, nevertheless, as an alternative, a recording material is also conceivable which does have a protective layer of simple design, as also proposed here, possibly on a completely novel recording layer.

To solve the problems in question, the invention proposes a heat-sensitive recording material with a substrate,

- which on its first side has at least one heat-sensitive recording layer with at least one dye precursor and at least one dye acceptor, wherein the dye precursors and dye acceptors react with one another under the action of heat to form color, and
- which on its second side has a pigment-containing back coating,
- wherein the back coating contains at least one polyurethane-based component which acts as a crosslinking agent.

DETAILED DESCRIPTION OF THE INVENTION

The inventors recognized that the printing problems observed on the backs of the known recording materials are associated with insufficient resistance of the surfaces to be printed to water. When, during the offset printing process, the surfaces to be printed make initial contact with the wet blanket, and the blanket then quickly and abruptly pulls away from printed surfaces, as is the case especially with modern high-speed printing presses, extremely high adhesive forces act on these printed surfaces, i.e., on the backs of the known recording materials. Loose or partially detached parts of the back coatings can be deposited in this way on the blankets of the offset printing couples. Once these relationships—which have been presented here in a simplified way—were recognized, various components which can act as crosslinking agents were tested, but these initially tested and known components were unable to meet the minimum requirements on a component of this type, namely,

- effective crosslinking of the coating color to be used to form the back coating,
- limited increase in viscosity when introduced into the coating color, and
- slow development of the crosslinking effect within the coating color.

In this connection, the last two points in particular are of basic importance with respect to handling behavior in the process technology of manufacturing a coating color: it must be possible to mix the coating color easily and to convey it to the coater; it must be possible for it to be processed uniformly in the coater without the buildup of incrustations or dirt pockets; and it must not start to set during the mixing and processing phase. The polyurethane-based components discovered in connection with the invention gave convincing proof of their effectiveness and helped make available a back coating for heat-sensitive recording materials that meets all of the requirements placed on it, such that, in particular, the back coating formed in this way shows excellent printability by the offset and flexographic printing processes.

Besides the three above-listed minimum requirements on a component acting as a crosslinking agent, it was also important to the inventors, with a view to the necessity of guaranteeing the greatest possible flexibility in the production process of heat-sensitive recording materials, that this component should help to form a coating color for the back coating that is stable for a comparatively long period of time, which means that it does not support excessive bacterial growth and/or thicken. The recording material of the invention has a back coating of a coating color, which, with moderate stifling, remains stable in storage for 5½ days before application and does not begin to set during this period. It was also important to the inventors that the component now being proposed as a crosslinking agent should not have any significant effect on the pH value of the coating color, since any significant change in the pH always has an effect, either undesirable or unpredictable, on the surface qualities of the coating. Finally, an important aspect for the crosslinking components proposed here is that they not be classified as hazardous substances. Their handling in the production process of the recording materials of the invention is thus not a critical matter, and these components also constitute a negligible hazard to man and the environment.

Especially calcium carbonate—preferably with a particle size in a colloidal range of 60-90%<2 μm—and/or magnesium carbonate were found to be effective as pigments in the back coating. The following pigments also gave positive results:

- both natural and calcined kaolin, preferably in the colloidal particle size range of 60-90%<2 μm,
- clay, silicic acid, and silicon dioxide, the last-mentioned pigment with a preferred mean particle size in the range of 6-10 μm,
- aluminum hydroxide and boehmite, the latter with possible mean particle sizes up to 0.5-3 μm, but it is especially preferred for these boehmite products to have a mean particle size in the range of from 10-100 nm, and
- especially talc with a preferred mean particle size in the range of 1-10 μm.

In numerous experiments on which this invention is based, mixtures of pigments, especially those named here, were also successfully used.

Besides the pigments and the polyurethane-based crosslinking component, which is preferably an anionic polyurethane in aqueous solution (for example, Eka SP AP 29, Eka Chemicals AB, 32301 Düren, Germany), the back coating contains binders, especially starch, styrene-butadiene latex, and possibly carboxymethyl cellulose. In addition, the mixing of different binders, in some cases in strongly divergent mixing ratios, is possible and preferred. Furthermore, optical brighteners, antifoaming agents, and components for controlling viscosity are used as standard additives according to the given requirements.

The back coating preferably contains

- pigments in amounts of 75-90 wt. %, and more preferably in amounts of 77-85 wt. %,
- binders in amounts of 5-25 wt. %, and
- polyurethane-based crosslinking agents in amounts of 0.5-8 wt. %, and more preferably in amounts of 1.5-3.5 wt. %.

If, as described above, the binder is present as a mixture, then the back coating preferably contains starch (and more preferably cornstarch) in amounts of 1-5 wt. % and styrene-butadiene latex in amounts of 4-20 wt. %, and more preferably 12-19 wt. %.

In the series of experiments on which this invention is based, it was discovered that a back coating with

- a pigment-binder ratio of 10:1-2:1 or better of 7.5:1-3:1 and
- a binder-crosslinker ratio of 20:1-1:1 or better of 10.5:1-5:1 meets the requirements placed on it especially well.

Especially positive results can be obtained with an application weight for the back coating in the range of 2-15 g/m$^2$. Depending on the available coaters and the intended purposes of the recording material of the invention, application weights for the back coating in the range of 2.5-4.5 g/m$^2$ are suitable, whereas the range of 8.5-12 g/m$^2$ is also suitable and is especially preferred. Coaters that are especially suitable for applying the back coating include especially leveling applicators such as doctor blade coaters and revolving doctor coaters as well as roll coaters, but the method of application is by no means limited to these types of coaters.

The inventors recognized that it is possible to obtain an especially high-quality printed image on the back of the heat-sensitive recording material of the invention if the back coating is formed in two layers, the first of which, namely, the layer facing the substrate layer, can be formed as a purely binder-pigment coating, while the second layer, namely, the outer layer, contains the polyurethane-based component that acts as the crosslinking component. In this case, it is possible for only the one layer to be applied by a leveling applicator, whereas the second layer can be applied with an air brush or curtain coater.

Where the heat-sensitive recording layer is concerned, the inventors recognized, with respect to the stated object, that the recording layer can contain, first of all, basically any of the known dye precursors, combinations of several dye precursors also being possible. The following are especially preferred as dye precursors:

- 6'-(dipentylamino)-3'-methyl-2'(phenylamino)spiro[isobenzofuran-1 (3H), 9'-[9H]xanthene]-3-one and
- spiro[isobenzofuran-1(3H), 9'-[9H]xanthene]-3-one-6'-(diethylamino)-3'-methyl-2'-(3-tolylamino)

and those selected from the group of fluoran compounds, including especially

- 3-diethylamino-6-methyl-7-anilinofluoran,
- 3-dibutylamino-6-methyl-7-anilinofluoran,
- 3-(N-methyl-N-propyl)amino-6-methyl-7-anilinofluoran,
- 3-(N-ethyl-N-isoamyl)amino-6-methyl-7-anilinofluoran,
- 3-(N-methyl-N-cyclohexyl)amino-6-methyl-7-anilinofluoran, 3-(N-ethyl-N-tolyl)amino-6-methyl-7-anilinofluoran, and
3-(N-ethyl-N-tetrahydrofuryl)amino-6-methyl-7-anilinofluoran.

In the same way, the heat-sensitive recording layer of the heat-sensitive recording material of the invention can contain basically any of the dye acceptors, especially organic dye acceptors, that are suitable for the possible dye precursors, especially the preferred dye precursors that have been cited. The heat-sensitive recording layer preferably contains at least one dye acceptor from the list comprising: 2,2-bis(4-hydroxyphenyl)propane, 4-[(4-(1-methylethoxy)phenyl)sulfonyl]phenol, 4-hydroxy-4'-isopropoxydiphenylsulfone, 4,4'dihydroxydiphenylsulfone, 2,4'-dihydroxydiphenylsulfone, N-(2-hydroxyphenyl)-2-[(4-hydroxyphenyl)thio]acetamide, N-(p-toluenesulfonyl)-N'-3-(p-toluenesulfonyloxyphenyl) urea according to the following Formula (1):

Formula (1):

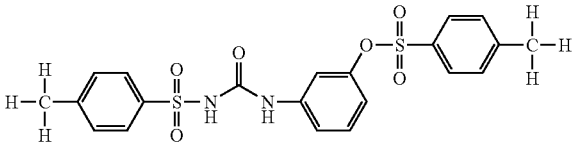

and urea-urethane compounds according to the following Formula (2):

Formula (2):

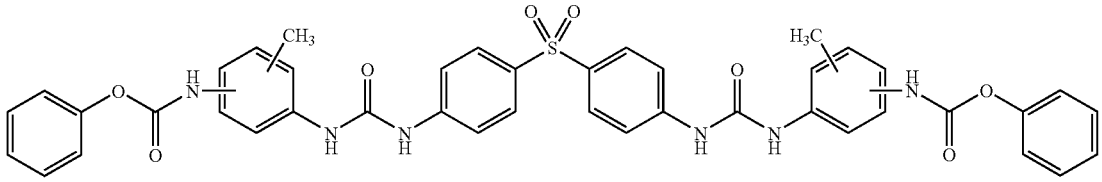

First especially preferred specific embodiment of the heat-sensitive recording layer:

In an especially preferred first embodiment of the heat-sensitive recording layer, this recording layer has a combination of two special dye acceptors, namely, N-(p-toluenesulfonyl)-N'-3-(p-toluenesulfonyloxyphenyl)urea according to Formula (1) and urea-urethane compounds according to Formula (2). No other dye acceptors are present in the recording layer.

In numerous series of experiments on which the present application is based, it was shown that, to achieve the best results, the ratio of the two dye acceptors N-(p-toluenesulfonyl)-N'-3-(p-toluenesulfonyloxyphenyl)urea according to Formula (1) and the urea-urethane compound according to Formula (2) in the heat-sensitive recording layer should be in the range of 2:1-1:3 and especially in the range of 1:1.25-1:2 in terms of their wt. %. To achieve the highest possible degrees of whiteness of the heat-sensitive recording layer, it is necessary to heat the urea-urethane compounds according to Formula (2) to 60° C. and to continue this heating uninterrupted for 24 hours before they are mixed with the other dye acceptor and/or with other components of the heat-sensitive recording layer.

Based on the total weight of the recording layer, the two dye acceptors of Formula (1) and Formula (2) can constitute up to 60 wt. % of the heat-sensitive recording layer, but they preferably constitute a fraction in the range of 25-35 wt. % of the heat-sensitive recording layer. The effect produced by the mixture of the two dye acceptors in their totality is a combination that results from the properties of the two individual dye acceptors. While numerous individual and cross-experiments revealed that N-(p-toluenesulfonyl)-N'-3-(p-toluenesulfonyloxyphenyl)urea according to Formula (1) is a dye acceptor that can be expected to result in high sensitivity of the heat-sensitive recording layer to the action of energy, urea-urethane compounds of Formula (2) can be described instead as dye acceptors that give the printed image induced by the action of energy a high degree of stability, especially to environmental influences. If the two dye acceptors are used in the recording layer in the mixing ratio that was recognized by the inventors, the result is a rapidly responding heat-sensitive recording material that shows little tendency towards background graying, has a heat-induced printed image that is stable to environmental influences, and guarantees good ability to be stamped and canceled.

Very generally and not restricted to the first and/or second especially preferred specific embodiment of the heat-sensitive recording layer, the recording layer of the heat-sensitive recording material of the invention preferably can also contain sensitizers with a melting point ideally of 60-180° C. and more preferably with a melting point of 80-140° C. to increase the thermal responsiveness. Sensitizers of this type include, for example, benzyl p-benzyloxybenzoate, stearamide, N-methylolstearamide, p-benzylbiphenyl, 1,2-di(phenoxy)ethane, 1,2-di(m-methylphenoxy)ethane, m-terphenyl, dibenzyl oxalate, benzyl naphthyl ether, diphenylsulfone, and 2-(2H-benzotriazole-2-yl)-p-cresol, where benzyl naphthyl ether, diphenylsulfone, 1,2-di(m-methylphenoxy)ethane, and 1,2-di(phenoxy)ethane are preferred.

Second especially preferred specific embodiment of the heat-sensitive recording layer:

In an especially preferred second embodiment of the heat-sensitive recording layer, the recording layer contains as the sole sensitizer 2-(2H-benzotriazole-2-yl)-p-cresol with the following Formula (3):

Formula (3):

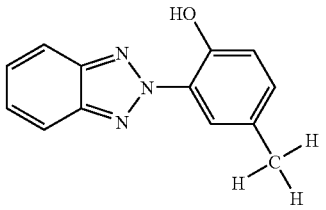

In combination with this sensitizer, the recording layer according to the second especially preferred specific embodiment of the heat-sensitive recording layer has N-(p-toluenesulfonyl)-N'-3-(p-toluenesulfonyloxyphenyl)urea according to Formula (1) as the dye acceptor. This dye acceptor can be incorporated in the heat-sensitive recording layer either in combination with other dye acceptors or preferably as the sole dye acceptor.

A ratio of the sensitizer according to Formula (3) to the dye acceptor according to Formula (1) in the range of 5:10-9:10, based on wt. % (absolutely dry), is especially preferred. This ratio is to be adjusted independently of whether the dye acceptor according to Formula (3) is used alone or in combination. When this ratio of the sensitizer of Formula (3) to the dye acceptor of Formula (1) is realized, the heat-sensitive recording layer exhibits not only good printability but also excellent stability to light.

For commercial reasons, the most suitable dye precursor within the second especially preferred specific embodiment is 3-dibutylamino-6-methyl-7-anilinofluoran, but the second embodiment is by no means limited to this dye precursor. Thus, the dye precursors listed as examples above can also be incorporated individually or in combination with one another in the heat-sensitive recording layer according to the second embodiment of the heat-sensitive recording layer discussed here.

Suitable binders for incorporation in the heat-sensitive recording layer, regardless of which of the specific embodiments and variants of the recording layer is in question, are, for example, water-soluble binders, such as starch, hydroxyethyl cellulose, methyl cellulose, carboxymethyl cellulose, gelatin, casein, polyvinyl alcohols, modified polyvinyl alcohols, sodium polyacrylates, acrylamide-acrylate copolymers, acrylamide-acrylate-methacrylate terpolymers, alkali salts of styrene-maleic anhydride copolymers, and alkali salts of ethylene-maleic anhydride copolymers, which can be used alone or combined with one another. It is also possible to use water-insoluble latex binders, such as styrene-butadiene copolymers, acrylonitrile-butadiene copolymers, and methyl acrylate-butadiene copolymers, as binders for incorporation in the heat-sensitive recording layer. In accordance with the present invention, polyvinyl alcohols in combination with acrylate copolymer are especially preferred binders, which are incorporated together in the heat-sensitive recording layer in amounts of 12-21 wt. %, based on the total weight of the recording layer.

To avoid gumming at a thermal head and to avoid excessive wear of the thermal head, the coating compound for forming the heat-sensitive recording layer, regardless of which of the specific embodiments and variants of the recording layer is in question, can also contain lubricants and parting compounds, including metal salts of higher fatty acids such as zinc stearate and calcium stearate, and waxes such as paraffin, oxidized paraffin, polyethylene, polyethylene oxide, stearamides, and castor wax. Other components of the recording layer are, for example, pigments, preferably inorganic pigments, such as aluminum (hydr)oxide, silicic acid, and calcium carbonate. Calcium carbonate is especially preferred and is incorporated in the recording layer in a preferred amount of 10-18 wt. %, based on the total weight of the recording layer.

It is preferred if a permanent color image or printed image can be formed in the recording layer under the action of heat.

The coating weight of the heat-sensitive recording layer, regardless of which of the specific embodiments and variants of the recording layer is in question, is preferably 2.5-12 g/m$^2$ and especially 3-6.5 g/m$^2$. Coating devices that can be used to apply the heat-sensitive recording layer include especially the doctor blade coater, revolving doctor coater, curtain coater, and air brush.

It is preferred if the coating color used to form the recording layer is aqueous. The subsequent drying of the coating color can be effected by means of microwave irradiation. It is also customary and has proven effective to supply heat for drying purposes such as by the use of hot-air suspension driers or contact driers. A combination of the cited drying methods is also contemplated.

Also preferred is the formation of a pigment-containing intermediate layer between the substrate layer and the recording layer, regardless of the specific embodiments. Pigments that have proven effective include both hollow-sphere organic pigments and inorganic pigments. The latter are preferably selected from the group comprising natural and calcined kaolin, silicon dioxide, here especially bentonite, calcium carbonate, and aluminum hydroxide, here especially boehmite. An intermediate layer of this type can make a positive contribution to the leveling of the surface of the base layer, which reduces the amount of coating color that it is necessary to apply for the heat-sensitive recording layer. For this reason, leveling coaters can be used to apply the intermediate layer; these include, for example, roll coaters, doctor blade coaters, and revolving doctor coaters. During the development of the printed image, furthermore, the pigments of this intermediate layer can absorb the wax components of the heat-sensitive recording layer that have been liquefied by the action of heat and thus promote the fast and reliable functioning of the heat-induced recording. The coating weight of the pigmented intermediate layer is preferably 5-20 g/m$^2$ and more preferably 7-11 g/m$^2$.

The recording material of the invention can have a protective layer, which is applied to the heat-sensitive recording layer and completely or partially covers it, regardless of the specific embodiments. The protective layer performs a task that also must be partly fulfilled by the back coating, namely, first, the task of protecting the recording layer underneath it from environmental influences, such as oils, fats, water, and plasticizers, and, second, the task of improving the printability, especially in the offset and flexographic printing processes.

The protective layer preferably contains a water-insoluble, self-crosslinking acrylic polymer as a binder, a crosslinking agent, and primarily an alkaline-processed bentonite as the pigment, where the pigment of the protective layer consists of one or more inorganic pigments, with at least 80 wt. % consisting of a highly purified, alkaline-processed bentonite, the binder of the protective layer consists of one or more water-insoluble, self-crosslinking acrylic polymers, and the binder/pigment ratio is in the range of from 7:1 to 9:1.

The self-crosslinking acrylic polymer in the protective layer of the preferred embodiment is a self-crosslinking binder selected from the group comprising styrene-acrylate copolymer, a copolymer of styrene-acrylate that contains acrylamide groups, and more preferably a copolymer based on acrylonitrile, methacrylamide, and acrylic ester. In addition to the alkaline-processed bentonite, it is also possible to incorporate natural or precipitated calcium carbonate, kaolin, silicic acid, aluminum hydroxide, or titanium dioxide into the protective layer as a pigment. With respect to the crosslinking agents, those which are especially preferred are selected from the group comprising cyclic urea, methylol urea, ammonium zirconium carbonate, and more preferably polyamide-epichlorohydrin resin.

The choice of a water-insoluble, self-crosslinking acrylic polymer as the binder and its ratio to the pigment in a range of from 7:1 to 9:1 and its ratio to the crosslinking agent of more preferably greater than 5:1 results in a high degree of environmental resistance of the proposed recording material, even with a protective layer with a relatively low coating weight.

The protective layer itself can be applied with standard coaters. For this purpose, a coating color of the type described above, for example, can be used, for which a coating weight in the range of from 1.5 to [–]4.5 g/m$^2$ is preferred, or, alternatively, the protective layer can also be imprinted. Protective layers that are especially suitable from the standpoint of processing technology and with respect to their technological properties are those which can be cured by actinic radiation. The term "actinic radiation" is understood to mean UV radiation or ionizing radiation, such as electron beams.

A variant that is more especially preferred as an alternative to the variant described above for a protective layer that completely or partially covers a heat-sensitive recording layer contains a polyvinyl alcohol as binder; zinc stearate; aluminum hydroxide or silicon dioxide as pigment; and one or more crosslinking agents. Especially preferred amounts for a protective layer of this type are given in Table 1 below:

TABLE 1

| Product | wt. % [oven-dried] |
|---|---|
| aluminum hydroxide | 10-25 |
| polyvinyl alcohol | 55-70 |
| zinc stearate | 7-9 |
| crosslinking agent | 6-7 |

Since the proposed back coating of the heat-sensitive recording material of the invention is to be dried thoroughly, it is possible in a single operation in a coating machine, for example, to apply and to dry both the back coating and the heat-sensitive recording layer, including the protective layer that completely covers it.

For this purpose, a coating machine of this type can have (a) an unwinding device, (b) a first coater such as a curtain coater, an air brush, or a revolving doctor coater for applying the heat-sensitive recording layer, (c) a first contactless suspension drier channel, (d) a curtain coater or an air brush for applying the protective layer, (e) optionally and depending on the model, a contactless web guide system, (f) a film applicator for applying the back coating, (g) a second contactless suspension drier channel, (h) a final drying section with several drying cylinders, (i) a remoistening system and a coating system such as a film applicator for optimizing flatness or reducing curling, (j) an IR drying system, (k) one or more calenders, each with one or more press nips, especially with the use of zone-controlled and/or shoe press rolls or ribbon calenders, and (1) a winding device.

There can also be provided, between the unwinding device (a) and the first coater (b), an additional coater (b') for example, a doctor blade coater with an associated drying apparatus (b"), which could be a suspension drier channel and/or a drying cylinder.

Although the substrate is not limited to paper, paper is the substrate which has proven commercially successful and environmentally compatible due to its good recyclability and is preferred in accordance with the invention.

Unless expressly noted otherwise, the data given in the specification and the claims with respect to coating weight, wt. % (weight-%), parts by weight, and component ratios are based on the absolutely dry weight, i.e., absolutely dry parts by weight. The term "air-dry" means, where used, that the components labeled in this way are described in their commercial delivery form.

The following examples and comparisons are provided for further illustration of the invention:

On a Fourdrinier paper machine, a paper web is produced as the substrate layer from bleached and ground hardwood and softwood pulp with a basis weight of 67 g/m$^2$ with the addition of standard additives in standard amounts. On the front, a revolving doctor coater is used for the online application within the coating machine of an intermediate layer of 8 g/m$^2$ that contains mainly calcined kaolin as pigment, styrene-butadiene latex as binder, and starch as cobinder.

With the use of a coating machine with a design of the type described above, the following layers are applied to the intermediate layer in the order specified: a heat-sensitive recording layer that contains dye formers and dye acceptors in a coating weight of 5.4 g/m$^2$ by means of a revolving doctor coater, a protective layer of 2.0 g/m$^2$ by means of an air brush, and a back coating of 3 g/m$^2$ by means of a roll coater with a downstream revolving doctor coater.

According to the following Examples 1, 5, 7, 9, and 12-14, highlighted in gray in Tables 2 and 3, and the Comparison Examples 2-4, 6, 8, 10-11, the formulations according to Table 2 were used to form the back coating. Results are also provided in the last row of Table 3.

Besides the pH value, the Brookfield viscosity of the coating color (spindle 3, 100 rpm, 23° C.) was determined after a stirring time (also given in Table 3) of 2 hours (h), 1 day (d), and 2 days in order to obtain information about the storage life of the various coating color samples for the formation of the back coating. Especially conspicuous here is the crosslinking agent based on epichlorohydrin resin, the use of which is associated with the danger of a sharp increase in viscosity all the way to solidification. The use of a crosslinking agent based on oxalic aldehyde can be associated with the risk of agglomeration and fractionation. In addition, with respect to the crosslinking agents based on epichlorohydrin resin and oxalic aldehyde, it should be noted that they are both hazardous substances and thus must be judged critically merely by reason of their human and environmental hazard. Another possible crosslinking agent, ammonium zirconium carbonate, was not considered in the series of experiments on which this invention is based due to its extremely irritating odor of ammonia.

The polyurethane-based crosslinking agent of the invention can be considered completely satisfactory with respect to low viscosity elevation and delayed development of crosslinking effect in all of the examples. The effectiveness of the crosslinking agents used in the examples was tested by the following method: Three days after the recording materials were produced, a test surface on the back of each sample of recording material was wetted with a few drops of water and then rubbed with moderate pressure with a finger moved in a circular pattern on the moistened test surface. The sample was rated "good" if the test surface remained smooth and no particles became detached, whereas the sample was rated "poor" if particles became detached from the surface or the whole surface actually dissolved. Here again, only the tested polyurethane-based crosslinking agent produced satisfactory results. The other crosslinking agents had barely any improving effect in some of the examples.

The tests described above thus vividly illustrate the superior properties of the recording material of the invention.

TABLE 2

| | | Example | | | | | | |
|---|---|---|---|---|---|---|---|---|
| | | 1 | 2 | 3 | 4 | 5 | 6 | 7 |
| | | Wt. % [oven-dried] | | | | | | |
| Pigment | calcium carbonate | 79.4 | 79.4 | 79.4 | 81.2 | | | |
| | silicon dioxide | | | | | 79.4 | 81.2 | |
| | kaolin | | | | | | | 79.4 |
| | talc | | | | | | | |
| Cornstarch | | 2.4 | 2.4 | 2.4 | 2.4 | 2.4 | 2.4 | 2.4 |
| Styrene-butadiene latex | | 15.9 | 15.9 | 15.9 | 15.9 | 15.9 | 15.9 | 15.9 |
| Crosslinking agent | . . . based on polyurethane (Eka SP AP 29, Eka Chemicals AB, 32301 Duren) | 1.8 | | | | 1.8 | | 1.8 |
| | epichlorohydrin derivative | | 1.8 | | | | | |
| | oxalic aldehyde | | | 1.8 | | | | |
| | no additive | | | | X | | X | |
| Antifoaming agent | | 0.1 | 0.1 | 0.1 | 0.1 | 0.1 | 0.1 | 0.1 |
| Viscosity regulator | | 0.4 | 0.4 | 0.4 | 0.4 | 0.4 | 0.4 | 0.4 |
| Pigment:binder ratio [oven-dried] | | 4.34:1 | 4.34:1 | 4.34:1 | 4.44:1 | 4.34:1 | 4.44:1 | 4.34:1 |
| Pigment:binder ratio [oven-dried] | | 10.12:1 | 10.12:1 | 10.12:1 | — | 10.12:1 | — | 10.12:1 |
| Evaluation, finger wipe test | | Good | — | Inadequate*1) | Poor | Fairly good | Poor | Good |

| | | Example | | | | | | |
|---|---|---|---|---|---|---|---|---|
| | | 8 | 9 | 10 | 11 | 12 | 13 | 14 |
| | | Wt. % [oven-dried] | | | | | | |
| Pigment | calcium carbonate | | | | 80.9 | 80 | 79.2 | 78.3 |
| | silicon dioxide | | | | | | | |
| | kaolin | 81.2 | | | | | | |
| | talc | | 79.4 | 81.2 | | | | |
| Cornstarch | | 2.4 | 2.4 | 2.4 | 2.4 | 2.4 | 2.4 | 2.4 |
| Styrene-butadiene latex | | 15.9 | 15.9 | 15.9 | 16.2 | 16.1 | 15.9 | 15.8 |
| Crosslinking agent | . . . based on polyurethane (Eka SP AP 29, Eka Chemicals AB, 32301 Duren) | | 1.8 | | | 1.0 | 2.0 | 3.0 |
| | epichlorohydrin derivative | | | | | | | |
| | oxalic aldehyde | | | | | | | |
| | no additive | X | | X | X | | | |
| Antifoaming agent | | 0.1 | 0.1 | 0.1 | 0.1 | 0.1 | 0.1 | 0.1 |
| Viscosity regulator | | 0.4 | 0.4 | 0.4 | 0.4 | 0.4 | 0.4 | 0.4 |
| Pigment:binder ratio [oven-dried] | | 4.44:1 | 4.34:1 | 4.44:1 | 4.35:1 | 4.32:1 | 4.33:1 | 4.30:1 |
| Pigment:binder ratio [oven-dried] | | — | 10.12:1 | — | — | 18.5:1 | 9.15:1 | 6.07:1 |
| Evaluation, finger wipe test | | Poor | Good | Poor | Poor | Fairly good | Very good | Very good |

*1)This means slightly improved compared to the result without the addition of crosslinking agent.

TABLE 3

| | | Viscosity [Brookfield (spindle 3, 100 rpm, 23° C.)] | | | Finger wipe test | |
|---|---|---|---|---|---|---|
| Test | pH | After 2 h | After 1 day | After 2 days | (after 3 days) | Comments |
| 1 | 8.4 | 22 | 24 | 16 | Good | |
| 2 | — | Solid | Solid | Solid | — | Coating color solid |
| 3 | 7.4 | 18 | 44 | ca.. 4,000 | Inadequate*1) | Agglomeration and fractionation |
| 4 | 8.4 | 22 | 24 | 16 | Poor | |
| 5 | 7.0 | 50 | — | — | Fairly good | |
| 6 | 7.0 | 48 | — | — | Poor | |
| 7 | 6.4 | 44 | — | — | Good | |
| 8 | 6.4 | 44 | — | — | Poor | |
| 9 | — | 450 | — | — | Good | |
| 10 | — | 450 | — | — | Poor | |
| 11 | — | — | — | — | Poor | |

TABLE 3-continued

| Test | pH | Viscosity [Brookfield (spindle 3, 100 rpm, 23° C.)] After 2 h | After 1 day | After 2 days | Finger wipe test (after 3 days) | Comments |
|---|---|---|---|---|---|---|
| 12 | — | — | — | — | Fairly good | |
| 13 | — | — | — | — | Very good | |
| 14 | — | — | — | — | Very good | |

*1)This means slightly improved compared to the result without the addition of crosslinking agent.

The invention is not limited by the embodiments described above which are presented as examples only but can be modified in various ways within the scope of protection defined by the appended patent claims.

The invention claimed is:

1. A heat-sensitive recording material comprising a substrate having a first side and a second side;

at least one heat-sensitive recording layer on said first side with at least one dye precursor and at least one dye acceptor, the dye precursors and dye acceptor reactable with one another under the action of heat to form color; and a pigment-containing back coating on said second side, said back coating containing at least one polyurethane-based component as a crosslinking agent.

2. The heat-sensitive recording material according to claim 1, wherein said pigment comprises calcium carbonate.

3. The heat-sensitive recording material according to claim 2, wherein said back coating additionally comprises the combination of starch and styrene-butadiene latex as binder.

4. The heat-sensitive recording material according to claim 1, wherein said back coating additionally comprises the combination of starch and styrene-butadiene latex as binder.

5. The heat-sensitive recording material according to claim 4, wherein said starch is present in said back coating in a range of from 1 to 5 wt. % and said styrene-butadiene latex is present in a range of from 12 to 19 wt. %.

6. The heat-sensitive recording material according to claim 1, wherein said polyurethane-based component is present in a range of from 0.5 to 8 wt. %.

7. The heat-sensitive recording material according to claim 1, wherein said pigment content of said back coating is in a range of from 75 to 90 wt. %.

8. The heat-sensitive recording material according to claim 1, additionally comprising a binder in said back coating and wherein the pigment-binder ratio in said back coating is in a range of from 10:1 to 2:1, and the binder-crosslinker ratio in said back coating is in a range of from 10.5:1 to 5:1.

9. The heat-sensitive recording material according to claim 1, wherein said heat-sensitive recording layer comprises two dye acceptors, which is N-(p-toluenesulfonyl)- N'-3-(p-toluenesulfonyloxyphenyl)urea of the formula (1):

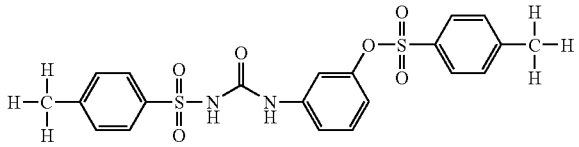

and a urea-urethane compound of the formula (2):

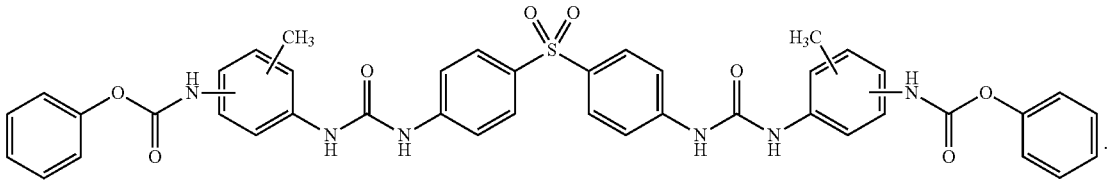

10. The heat-sensitive recording material according to claim 1, wherein said heat-sensitive recording layer comprises N-(p-toluenesulfonyl)-N'-3-(p-toluenesulfonyloxyphenyl)-urea of the formula (1) as the dye acceptor:

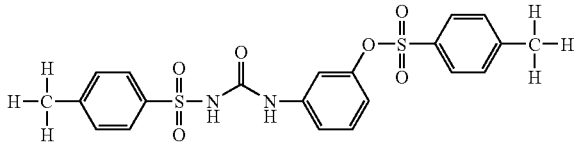

and 2-(2H-benzotriazole-2-yl)-p-cresol of the formula (3) as the sole sensitizer:

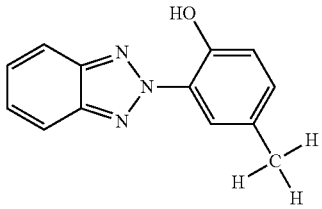

* * * * *